US010043325B2

(12) United States Patent
Friedli

(10) Patent No.: US 10,043,325 B2
(45) **Date of Patent: *Aug. 7, 2018**

(54) ACCESS CONTROL FOR AREAS WITH MULTIPLE DOORS

(71) Applicant: Inventio AG, Hergiswil (CH)

(72) Inventor: Paul Friedli, Remetschwil (CH)

(73) Assignee: INVENTIO AG, Hergiswil (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/774,312

(22) PCT Filed: Mar. 11, 2014

(86) PCT No.: PCT/EP2014/054752

§ 371 (c)(1),
(2) Date: Sep. 10, 2015

(87) PCT Pub. No.: WO2014/140048

PCT Pub. Date: Sep. 18, 2014

(65) Prior Publication Data

US 2016/0035160 A1 Feb. 4, 2016

(30) Foreign Application Priority Data

Mar. 15, 2013 (EP) ..... 13159366

(51) Int. Cl.
*G07C 9/00* (2006.01)
*B66B 1/46* (2006.01)
(Continued)

(52) U.S. Cl.
CPC ..... *G07C 9/00007* (2013.01); *B66B 1/468* (2013.01); *E05F 15/76* (2015.01);
(Continued)

(58) Field of Classification Search
CPC . G07C 9/00103; E05F 15/76; E05F 2015/765
See application file for complete search history.

(56) References Cited

U.S. PATENT DOCUMENTS

2003/0132830 A1* 7/2003 Dow ..... H04N 7/186 340/5.22
2004/0098915 A1* 5/2004 Baldry ..... E05B 17/0029 49/339

(Continued)

FOREIGN PATENT DOCUMENTS

EP 1958908 A1 8/2008
EP 2316771 A1 5/2011

(Continued)

OTHER PUBLICATIONS

Machine Translation of WO 2012/111146A1.*

*Primary Examiner* — Nabil Syed
(74) *Attorney, Agent, or Firm* — William J. Clemens; Shumaker, Loop & Kendrick, LLP

(57) ABSTRACT

An access control system detects movement at a door to which a user has been granted access. A travel time is determined that describes how long the user is expected to need to travel between that door and another door in the area. After the travel time has elapsed, the other door is unlocked. Thus, the user can travel to and open the other door without having to present a credential for the other door.

20 Claims, 7 Drawing Sheets

(51) Int. Cl.
*E05F 15/76* (2015.01)
*E05F 15/79* (2015.01)
*E05F 15/73* (2015.01)

(52) U.S. Cl.
CPC ..... *E05F 15/79* (2015.01); *G07C 9/00103* (2013.01); *B66B 2201/4615* (2013.01); *B66B 2201/4676* (2013.01); *E05F 2015/765* (2015.01); *G07C 2209/08* (2013.01)

(56) References Cited

U.S. PATENT DOCUMENTS

| | | | | |
|---|---|---|---|---|
| 2008/0196979 | A1* | 8/2008 | Sakurai | B66B 1/2458 187/387 |
| 2008/0290988 | A1 | 11/2008 | Crawford | |
| 2011/0048862 | A1 | 3/2011 | Schwarzentruber | |
| 2013/0048436 | A1* | 2/2013 | Chan | B66B 1/2408 187/387 |

FOREIGN PATENT DOCUMENTS

| | | | | |
|---|---|---|---|---|
| JP | 2004204629 | A | 7/2004 | |
| JP | WO 2012111146 | A1 * | 8/2012 | G07C 9/00 |
| WO | 2009132691 | A1 | 11/2009 | |
| WO | 2012101770 | A1 | 8/2012 | |

* cited by examiner

FIG. 4

400

| Int. Door 120 | Int. Door 122 | Int. Door 124 | Ele-vator 130 | Ele-vator 132 | Ext. Door 110 | |
|---|---|---|---|---|---|---|
| -- | 5 m | 10 m | 4 m | 7 m | 10 m | Int. Door 120 |
| | -- | 5 m | 9 m | 12 m | 7 m | Int. Door 122 |
| | | -- | 14 m | 17 m | 10 m | Int. Door 124 |
| | | | -- | 3 m | 11 m | Ele-vator 130 |
| | | | | -- | 9 m | Ele-vator 132 |
| | | | | | -- | Ext. Door 110 |

ACCESS CONTROL FOR AREAS WITH MULTIPLE DOORS

FIELD

This disclosure relates to access control systems.

BACKGROUND

In areas secured by an access control system, users are often required to present some form of credential before being allowed to pass through a door or other barrier. For example, a user may need to use one or more of a key (mechanical or electronic), a code, a biometric feature or other device to obtain access.

U.S. 2011/0048862 A2 describes an elevator system in a building. When movement of a door in the building is detected (e.g., movement of an apartment door as it is being closed or opened), an elevator car is sent to the floor where the door is located. The elevator doors open at the floor after a passenger-specific route time has expired.

Further options for access control could be advantageous.

SUMMARY

An access control system detects movement at a door to which a user has been granted access based on a credential presented by the user. A travel time is determined that describes how long the user is expected to need to travel between that door and another door in the area. After the travel time has elapsed, the other door is unlocked. Thus, the user can travel to and open the other door without having to present the credential for the other door.

In some embodiments, an access control method comprises: identifying a user based on a credential presented by the user; granting the user access for a first door based on the credential; detecting a movement at the first door; determining a travel time for the user between the first door and a second door, the second door being a building door; and granting the user access for the second door after the travel time for the user between the first door and the second door has elapsed since the movement at the first door, wherein access for the second door is being granted without the user presenting the credential for the second door. The method can further comprise: determining that the user has not opened the second door within a time window; and relocking the second door. In some cases, the first door comprises an elevator door and the second door comprises an apartment door or an office door. In other cases, the first door comprises an exterior door and the second door comprises an interior door. The detected movement at the first door comprises a movement of the user at the first door or a movement of the first door. The identifying the user can occur as part of placing a destination call for an elevator system. The identifying the user can comprise reading information from a data carrier. The determining the travel time can comprise reading a pre-defined travel time from a database. In some cases, the determining the travel time is based on a pre-defined walk speed for the user and on a pre-defined distance between the first door and the second door.

In some embodiments, the access control method further comprises: detecting a movement at the second door; determining a travel time for the user between the second door and a third door; and granting the user access for the third door after the travel time for the user between the second door and the third door has elapsed since the movement at the second door.

In further embodiments, the access control method further comprises: determining that the user has not opened the second door within a time window; and canceling an action for granting the user access for a third door.

Some embodiments of a building access control system comprise: a first door; a door sensor for the first door; an input device for the first door; a second door, the second door not being an elevator door; and a computer-based control unit, the control unit comprising a processor and a computer-readable storage medium with instructions that, when executed by the processor, cause the control unit to identify a user based on a credential presented by the user, grant the user access for a first door based on the credential, detect a movement at the first door, determine a travel time for the user between the first door and a second door, and grant the user access for the second door after the travel time for the user between the first door and the second door has elapsed since the movement at the first door, wherein access for the second door is being granted without the user presenting the credential for the second door.

Further embodiments comprise a computer-based device configured to perform one or more of the disclosed methods.

At least some embodiments of the disclosed methods can be implemented using a computer or computer-based device that performs one or more method acts, the computer or computer-based device having read instructions for performing the method acts from one or more computer-readable storage media. The computer-readable storage media can comprise, for example, one or more of optical disks, volatile memory components (such as DRAM or SRAM), or non-volatile memory components (such as hard drives, Flash RAM or ROM). The computer-readable storage media do not cover pure transitory signals. The methods disclosed herein are not performed solely in the human mind.

DESCRIPTION OF THE DRAWINGS

The disclosure refers to the following figures, in which:

FIG. 4 shows an exemplary embodiment of a distance table.

DETAILED DESCRIPTION

Figure 1:
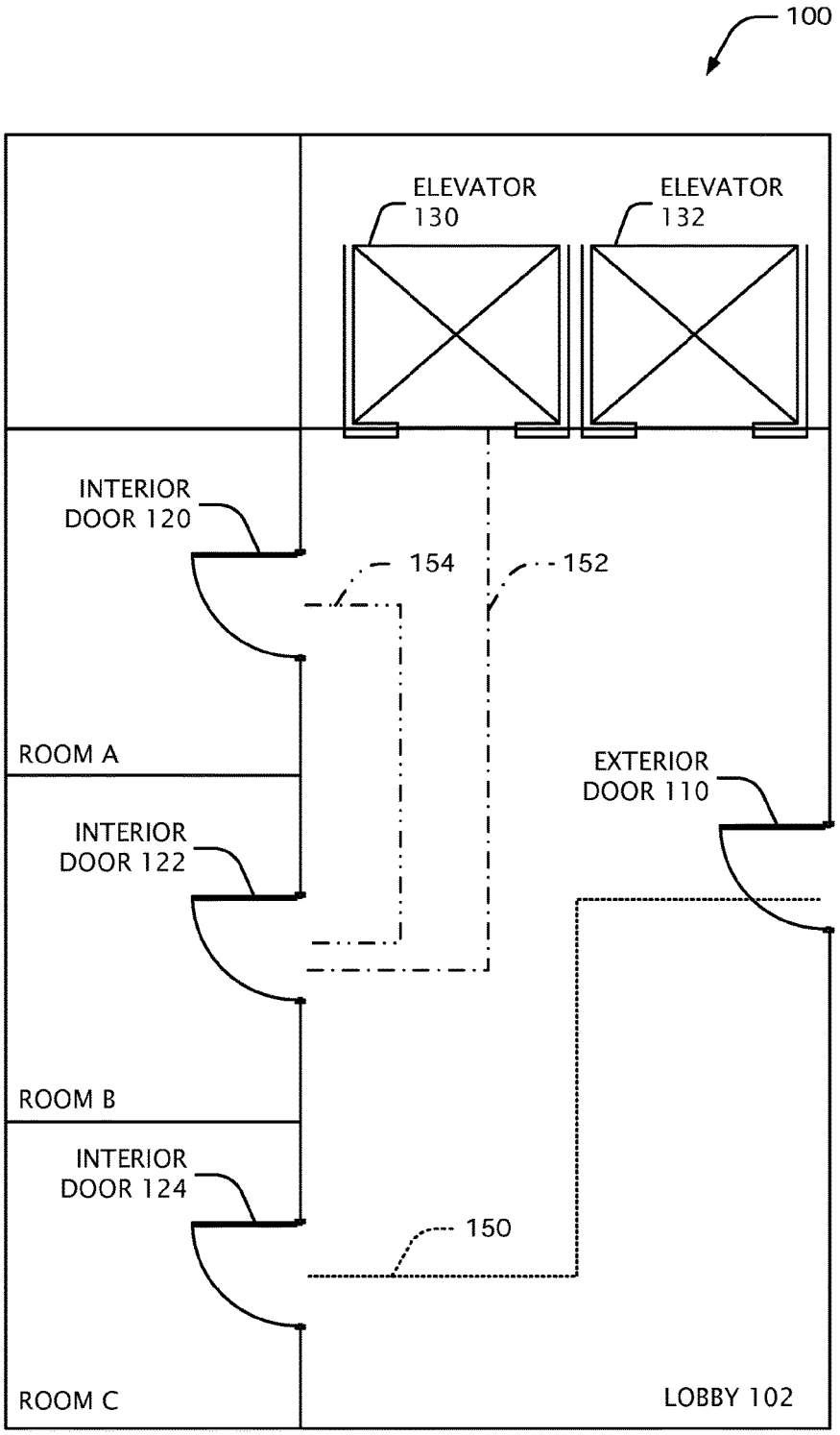
FIG. 1 shows a plan view of an exemplary embodiment of a building floor.

FIG. 1 shows a plan view of an exemplary embodiment of a building floor 100 in which various embodiments of the disclosed technologies can be used. The floor 100 comprises a lobby 102, which is accessible from outside of the building by an exterior door 110. Interior doors 120, 122, 124 allow access to rooms A, B, and C, respectively. In this particular example, the lobby 102 is also served by two elevators 130, 132. In further embodiments, doors that control access to other areas (e.g., stairwells, garages, storage spaces, outdoor spaces) are present.

As used in this application and in the claims, a "door" refers generally to a barrier that is used to control access to an area. Thus, in addition to planar elements that slide or that rotate on hinges, a door can also include barriers such as a gate or a turnstile. Such barriers can be physical (e.g., a bar or other object) or sensor-based (e.g., an optical sensor, a motion sensor, or another sensor). In some cases, a door is an elevator door. The phrase "building door" refers to a door that is not an elevator door, but can include an exterior door, an interior door, an office door, a turnstile, or another type of barrier.

Figure 2:
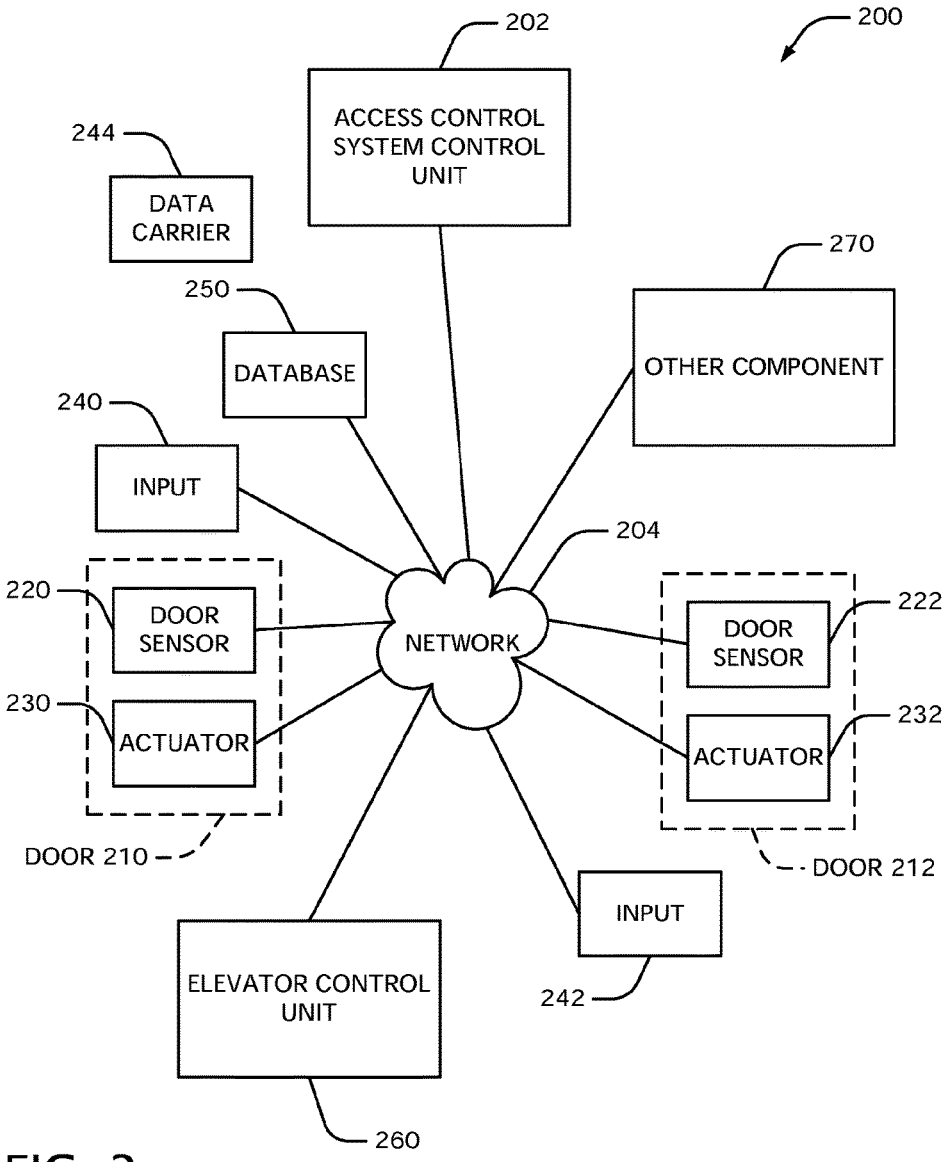
FIG. 2 shows a block diagram of an exemplary embodiment of an access control system.

FIG. 2 shows a block diagram of an exemplary embodiment of an access control system 200. The system 200 comprises a computer-based control unit 202. The control unit 202 comprises at least one processor and at least one computer-readable storage medium, which stores instructions for the processor. When the processor executes the instructions, the control unit 202 performs one or more of the method acts disclosed herein. The control unit 202 is communicatively coupled to additional components through a network 204. The control unit 202 is coupled to a door 210 and to a door 212.

The doors 210, 212 can comprise respective door sensors 220, 222. The door sensors 220, 222 detect movement at the respective door. This detecting can comprise detecting the movement of the user at or near the door. This movement of the user can result from the user passing through the door. This detecting can also comprise detecting movement of the door 210, 212. For example, the sensors 220, 222 can detect if the door is being opened, being closed, or both. Generally, the sensors 220, 222 can comprise motion sensors, optical sensors, pressure sensors, camera sensors, or other sensors.

One or both of the doors 210, 212 can further comprise respective actuators 230, 232, which can operate in response to an electronic signal. For example, in some embodiments, the actuator 230 can lock or unlock a lock for the door 210. In further embodiments, the actuator 230 can open or close the door 210.

The system 210 can also include additional doors.

Also coupled to the control unit 202 is an input device 240 for the door 210. The input device 240 obtains credential information for a user and provides this information to the control unit 202. Generally, credential information allows for distinguishing a user from one or more other users, and examples of credential information are given below. The credential information can be provided by the user with a data carrier 244, for example, one or more of: an RFID (radio-frequency identification) device (e.g., having a card form factor or other form factor), including near-field communication (NFC) devices and far-field communication devices; magnetic storage devices (e.g., magnetic strip cards); or optical code devices. Accordingly, the input device can comprise an RFID reader, an NFC reader, a magnetic reader, an optical scanner, or another type of reader. In additional embodiments, the credential information is provided by the user through a keypad or a biometric reader. In FIG. 2, an input device 242 is also provided for the door 212.

The control unit 202 is also coupled to a database 250. The database 250 stores information that describes, for example, access rights for one or more users. The database 250 can also store "automatic destinations" for one or more users. An automatic destination is an indication of a door through which a user is expected to pass after passing through a previous door. The database 250 can also store additional information, as described herein.

In further embodiments, the control unit 202 is also coupled to a computer-based elevator control unit 260. The elevator control unit 260 can control one or more aspects of an elevator system in a building (though some embodiments can be used in settings where no elevator installation is present).

The control unit 202 can also be coupled to one or more other components 270. For example, the other component 270 can be a remote monitoring system.

In some cases, the components of the system 200 are located locally, while in other cases, at least some components are remotely located from each other (e.g., the components form a distributed system).

Figure 3:
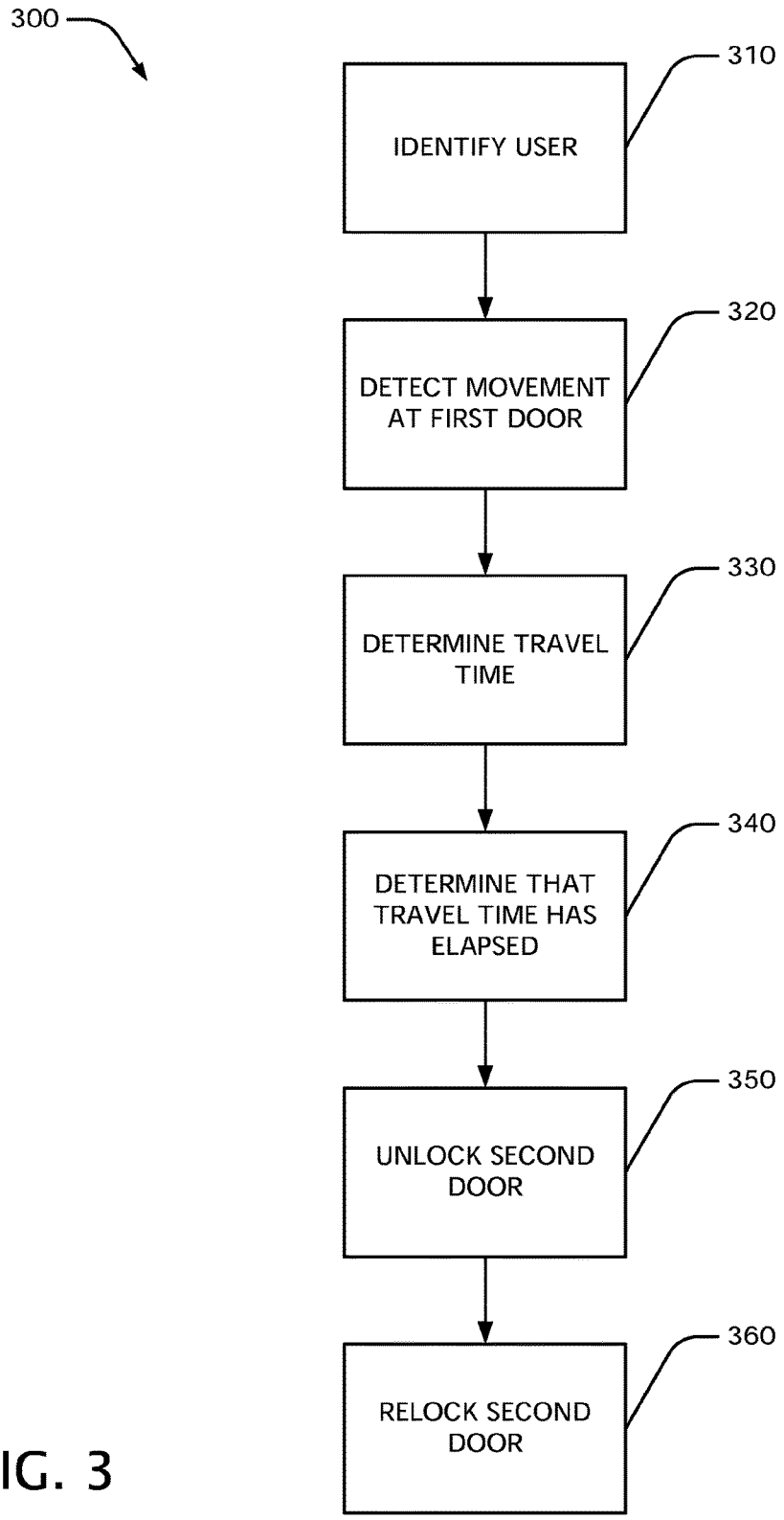
FIG. 3 shows a flow diagram of an exemplary embodiment of an access control method.

FIG. 3 shows a flow diagram of an exemplary embodiment of an access control method 300. At least a portion of the method 300 can be performed using, for example, a component such as the control unit 202. Although the method 300 is described herein as being performed in the context of a system such as the system 200 of FIG. 2, it can also be used with other systems.

In a method act 310, a user is identified. This identification is made based on credential information provided to the control unit 202, possibly through an input device 240, 242. Generally, a user is "identified" when the access control system is able to distinguish the user from one or more other users or groups of users. Depending on the embodiment, the credential information comprises, for example, one or more of a name for the user, a number, a biometric feature, or another type of information.

In a method act 320, movement at a first door is detected. The first door is one to which the passenger has access (perhaps as a result of providing the credential information), and the movement is assumed to result from the identified user passing through the door. The movement is detected using one or more sensors, for example, the door sensor 220, 222.

In a method act 330, a travel time for the user is determined. The travel time describes the approximate amount of time that the user is expected to take to travel from the first door to a second door. For example, in the context of the building floor 100 of FIG. 1, the access control system determines a travel time for the user to travel from the exterior door 110 to the interior door 124. The second door is determined based on an automatic destination for the user.

In a method act 340, the access control system determines that the travel time has elapsed since the detecting of the movement at the first door. By this point, the user is expected to be at or near the second door.

In a method act 350, the second door is unlocked. This can be performed using, for example, a command sent to an actuator 230, 232 of the second door. The second door can then be opened by the user. A door is "unlocked" when an impediment to the user passing through the door is physically or electronically removed. For a door with a mechanical lock, this could mean, for example, that a deadbolt is opened. For some doors, this could mean that an electronic alarm is deactivated. A door is "locked" or "relocked" when the corresponding impediment for the door is physically or electronically activated.

Particular embodiments of the method 300 comprise an additional method act 360, in which the second door is re-locked after the access control system determines that the second door has not been opened within a certain amount of time. This determination can be based on data from a sensor for the second door. This time limit can be, for example, 10 seconds, 20 seconds, 30 seconds, 60 seconds, 2 minutes, 5 minutes or another amount of time. In some cases, the time limit can be set by a user or by a system administrator. This feature can help prevent an unauthorized party from opening the second door after it has been unlocked. For example, the second door can be unlocked for a user, but the user may be delayed from reaching the second door. Since the user is not present to open the second door, the door is re-locked after an additional amount of time has passed.

In some cases, the second door is unlocked such that the unlocking is not apparent to anyone who happens to be near the second door at the time. For example, the unlocking is not indicated by any audio or visual indicators on or near the second door. This can improve the security of the access control system, since otherwise an unauthorized person may notice that the second door is unlocked and then open the door.

Various methods can be used to determine the travel time for a given user and a given pair of doors.

In some embodiments, the distance between the first and second doors is retrieved from a table stored in the database 250. FIG. 4 shows an exemplary embodiment of a distance table 400. In this particular example, the distance table 400 describes distances between various doors of the floor 100 of FIG. 1. For example, table 400 shows that: the path 150 between the exterior door 110 and the interior door 124 has a length of 10 meters; the path 152 between the elevator 130 and the interior door 122 has a length of 9 meters; and the path 154 between the interior door 120 and the interior door 122 has a length of 5 meters. Of course, the size of the table 400 and the actual values stored therein vary according to the particular embodiment.

In some cases, the distances between two doors are calculated based on a coordinate system describing the locations of the doors in an area and based on a path that the user is expected to take between the doors. The paths 150, 152, 154 are shown in FIG. 1 as comprising straight lines with 90-degree turns, but the paths can also be modeled with curved lines, which may better represent the actual paths that users walk between doors.

Once the appropriate distance has been retrieved, a user's individual walking speed can be retrieved from another table stored in the database 250. The individual walking speed is manually added to the database previously. In some cases, the individual walking speed can be modified by one or more of the user, an administrator, or another party.

The access control system calculates the travel time based on the distance between the first and second doors and the user's individual walking speed.

In other embodiments, the travel time for a given user and a given pair of doors is manually programmed into a list in the database 250.

Some embodiments of the disclosed technologies can be used with an elevator system. As shown in FIG. 2, the control unit 202 can be coupled to an elevator control unit 260. In such cases, the elevator doors (e.g., the elevator hall doors or the car doors) can serve as the first door in the method 300. After the elevator doors open at the destination floor and the travel time has elapsed, then the second door is unlocked. In some cases, the second door is for an office or apartment of the user. The user can be identified before boarding the elevator to travel to the destination floor where the second door is located. For example, in cases where the elevator system uses destination call control technology (such as Schindler ID or PORT from the Schindler Group of Switzerland), the user can be identified as part of placing a destination call for the elevator. The destination call can be placed using any type of credential described herein.

In further embodiments, the elevator doors (e.g., the elevator hall doors or the car doors) can serve as the second door in the method 300.

Figure 5:
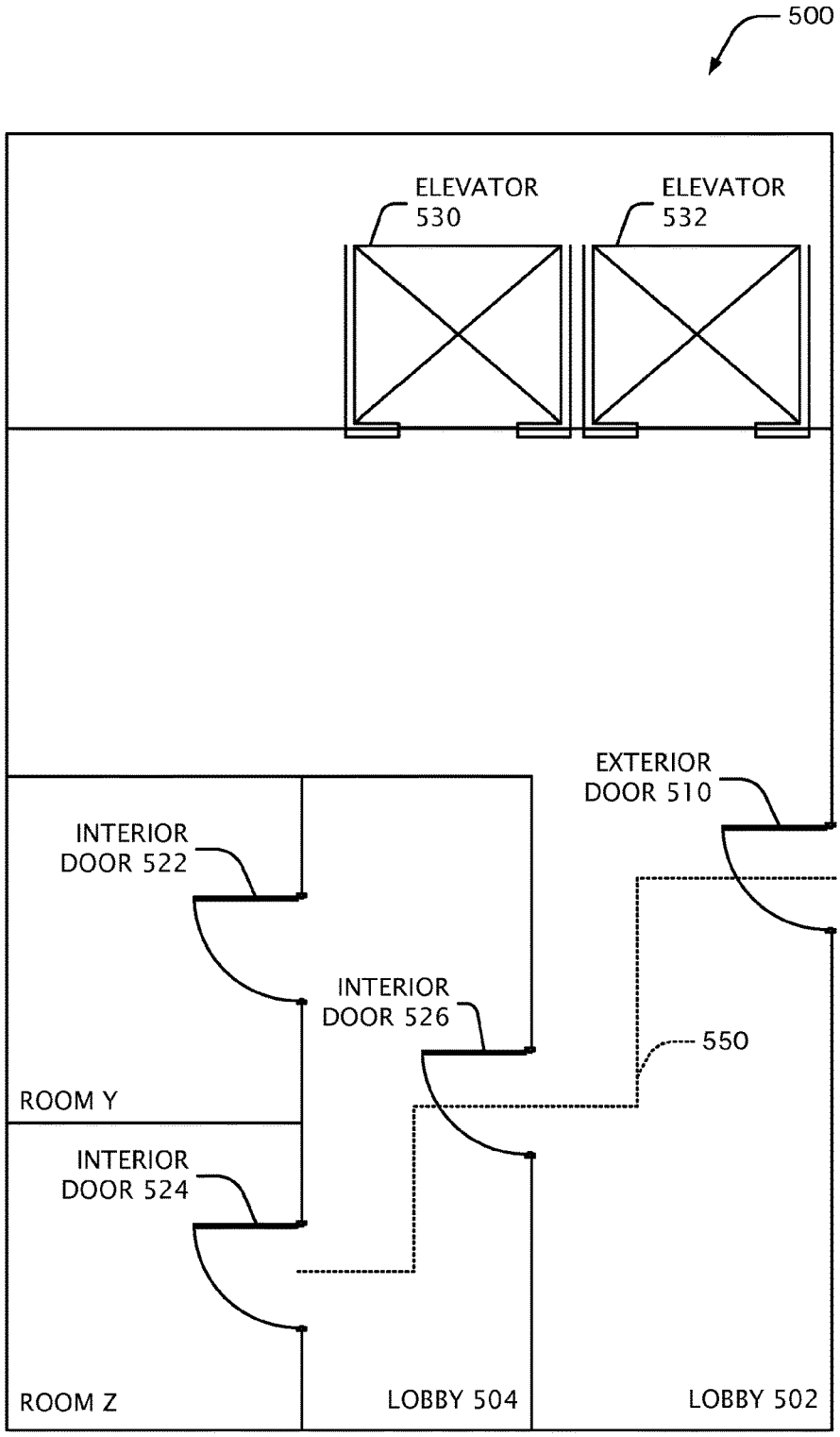
FIG. 5 shows a plan view of an exemplary embodiment of a building floor.

In particular embodiments, two or more doors are unlocked successively after a user is identified and after movement at a first door is detected. FIG. 5 shows an exemplary embodiment of a building floor 500 where such embodiments can be used. In FIG. 5, an exterior door 510 opens into a lobby 502, where an interior door 526 opens into a second lobby 504. From the lobby 504, interior doors 522, 524 open into rooms Y and Z, respectively. Elevators 530, 532 are also accessible from the lobby 502.

When a user is identified and movement at a first door (e.g., the exterior door 510) is detected, then a travel time for the user between the first and second doors is determined In this particular example, the second door is the interior door 526, and the user is generally traveling along the path 550. (Of course, these details are only non-limiting examples.) After the determined travel time between the first and second doors has elapsed, the second door (interior door 526) is unlocked. A travel time for the user between the second door and a third door (here, interior door 524) is also determined. Once the movement at the second door is detected, and after the travel time between the second and third doors has elapsed, the third door is unlocked for opening by the user. Thus, the user can use a credential to gain access to a first door and then pass through multiple additional doors without having to present the credential again.

If the access control system unlocks the second door, for example, but does not detect the second door as being opened within a time limit, then any further doors that the user was expected to pass through (e.g., the third door) are not unlocked. This may be relevant in situations where, for example, the user is delayed before opening the second door, or where the user simply takes a different path through the floor 500 than expected by the access control system.

Although not shown in FIG. 2 or FIG. 5, at least some of the doors have readers for obtaining credential information (e.g., for reading RFID cards or other credentials). In some cases, each door has its own reader.

Figure 6:
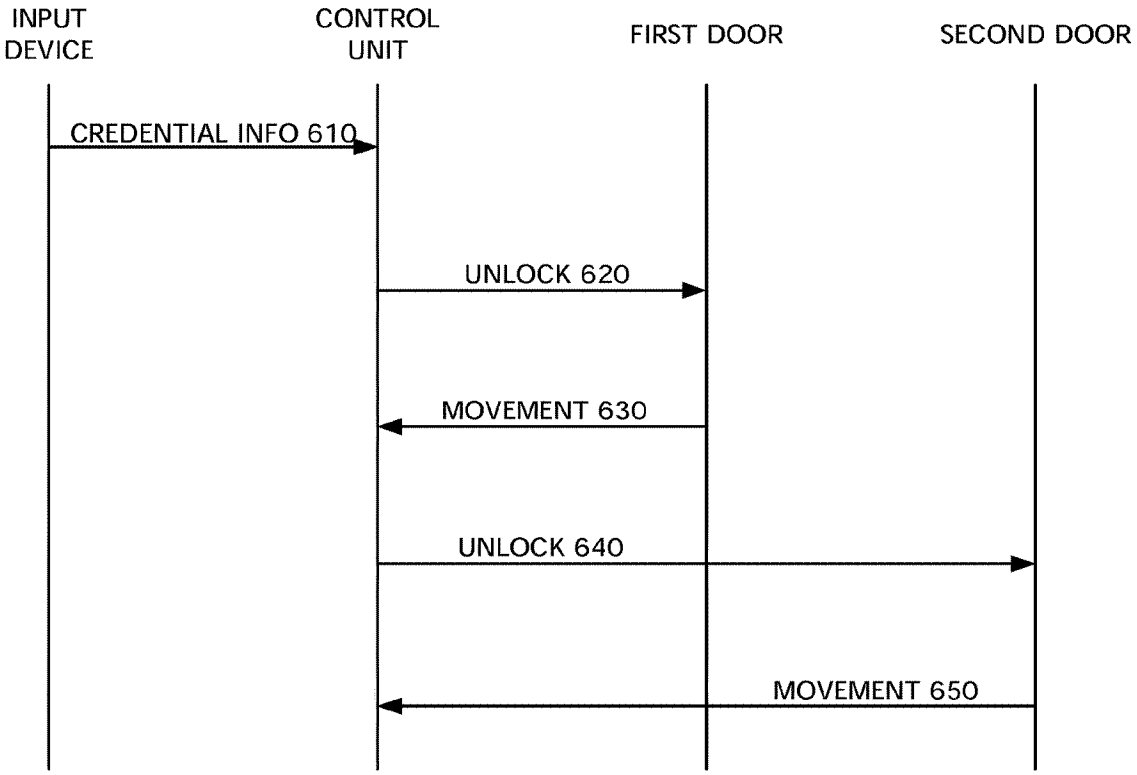
FIG. 6 shows a signal diagram for an exemplary exchange of signals in an access control system.

FIG. 6 shows a signal diagram for an exemplary exchange of signals in an access control system using one or more embodiments of the disclosed technologies. For ease of reference, the signal diagram is described in the context of the system 200 of FIG. 2 and of the method 300 of FIG. 3, but other systems and methods can also be used.

During the signal exchange, an input device 240 receives credential information and sends the information to the access system control unit 202 in a signal 610. The control unit 202 verifies that the user associated with the credential information is authorized to pass through a first door (e.g., the door 210), and the control unit 202 then sends an unlock signal 620 to the first door (e.g., to the actuator 230). Once movement at the first door is detected, indicating that the user is passing through the first door, a movement signal 630 is sent from the first door to the control unit 202. The movement signal 630 is generated by the door sensor 220. The control unit 202 then waits for the user's travel time to elapse, after which it sends an unlock signal 640 to a second door (e.g., the door 212). The unlock signal 640 is sent to, for example, the actuator 232. Once the user opens the unlocked second door, the second door sends a movement signal 650 to the control unit 202. The movement signal 650 is generated by the door sensor 222 and confirms to the central control unit that the second door was opened.

Figure 7:
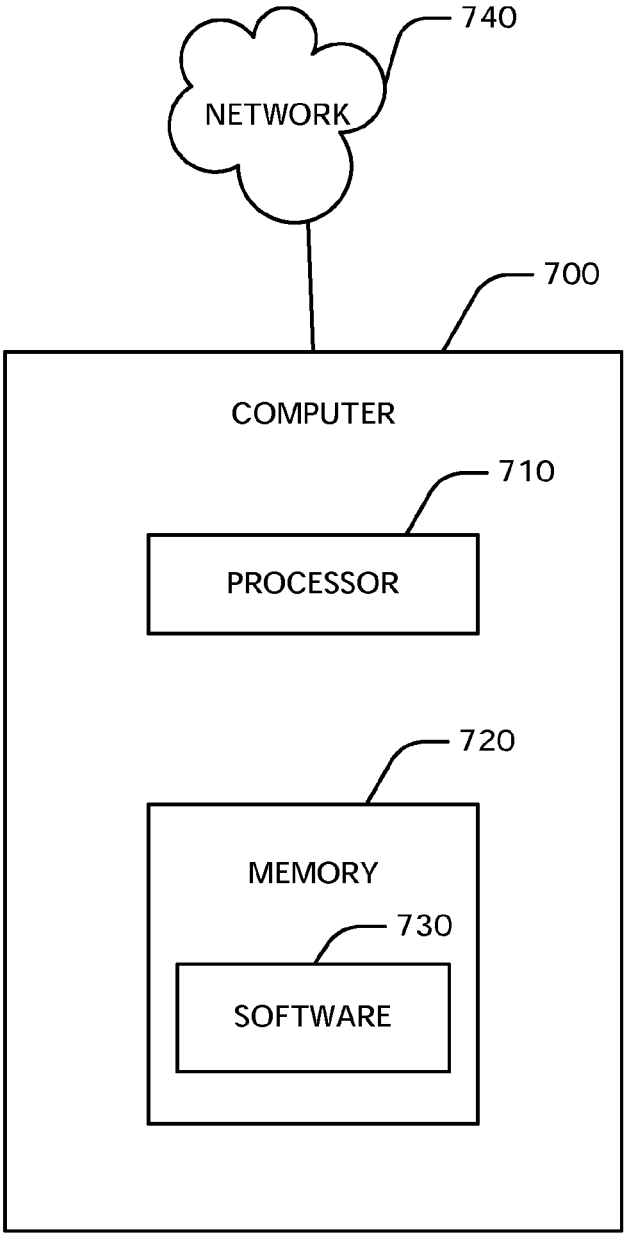
FIG. 7 shows a block diagram of an exemplary embodiment of a computer.

FIG. 7 shows a block diagram of an exemplary embodiment of a computer 700 (e.g., part of an access control system control unit, part of an elevator control unit, part of a reader, part of a database) that can be used with one or more technologies disclosed herein. The computer 700 comprises one or more processors 710. The processor 710 is coupled to a memory 720, which comprises one or more computer-readable storage media storing software instructions 730. When executed by the processor 710, the software instructions 730 cause the processor 710 to perform one or more of the method acts disclosed herein. Further embodiments of the computer 700 can comprise one or more additional components. The computer 700 can be connected to one or more other computers or electronic devices through an input/output component (not shown). In at least some embodiments, the computer 700 can connect to other computers or electronic devices through a network 740. In particular embodiments, the computer 700 works with one or more other computers, which are located locally, remotely, or both. One or more of the disclosed methods can thus be performed using a distributed computing system.

At least some of the disclosed embodiments can allow a user to pass through multiple doors without having to present a credential to open each door. Instead, the user only needs to present the credential before passing through the first door. One or more successive doors are unlocked automatically after the appropriate travel time has elapsed. Waiting for the elapse of the travel time can also help ensure that a door is not unlocked too early (e.g., before the user arrives at the door to open it). This can reduce the risk that an unauthorized person will open the unlocked door instead of the user. Additionally, not having to unlock every door manually can be helpful to, for example, users whose hands are full (e.g., carrying shopping bags or other objects) or who are disabled. The disclosed technologies can also provide a user with a feeling of personal attention while passing through the building or other area.

In one non-limiting example, a user approaches an exterior building door. The user presents an electronic key (an RFID card) to a reader that is positioned near the exterior door. The reader reads credential information from the card (in this case, an identification number associated with the user) and sends this information to an access control system control unit. The control unit determines that the user is authorized to use the exterior door, and so the control unit unlocks the exterior door. After detecting that the user has opened the exterior door, the control unit determines a travel time for the user to move from the exterior door to an office door. During this time, the user is walking from the exterior door to the office door. After the travel time has elapsed, the control unit unlocks the office door. At about the same time, the user arrives at the office door and opens the door.

In another non-limiting example, a user travels in an elevator car to a floor where the user's apartment is located. Before boarding the elevator, the user placed a destination call using an RFID card. As a result, the elevator system and the access control system have identified the user. The access control system has also determined that the travel time for the user from the door of the elevator on the destination floor to the apartment door is fifteen seconds. Once the elevator car arrives at the floor where the apartment is located, the elevator hall doors open. This door movement is communicated to the access control system. Meanwhile, the user exits the elevator and walks toward the apartment door. After the fifteen-second travel time has elapsed, the access control system unlocks the apartment door. However, the user is not at the apartment door at this point, since the user stopped in the hallway to speak with a neighbor. The access control system provides a thirty-second window for the user to open the unlocked apartment door. When this window lapses without the access control system having received an indication that the apartment door was opened, the apartment door is re-locked. Later, the user unlocks the apartment door using the RFID card and opens the door.

Although certain data are described herein as being stored in a table, a list, or in another data structure, generally such data can be stored in any suitable type of data structure. This applies to, for example, individual walking speed data and data for distances between doors.

Although some embodiments of the various methods disclosed herein are described as comprising a certain number of method acts, further embodiments of a given method can comprise more or fewer method acts than are explicitly disclosed herein. In additional embodiments, method acts are performed in an order other than as disclosed herein. In some cases, two or more method acts can be combined into one method act. In some cases, one method act can be divided into two or more method acts.

As used herein, a "user" can be a person, a group of persons, a machine, or an animal.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An access control method comprising the steps of:

identifying a user based on a credential presented by the user;

granting the user access for a first door based on the credential;

detecting a movement at the first door;

determining a travel time for the user between the first door and a second door, the second door being a building door;

granting the user access for the second door after the travel time for the user between the first door and the second door has elapsed since the movement detected at the first door, the access for the second door being granted without presenting any credentials at the second door; and denying access to the second door after the travel time for the user between the first door and the second door has elapsed and a time limit has elapsed.

2. The access control method according to claim 1 further comprising the steps of:

determining that the user has not opened the second door within a time window; and relocking the second door based on the determining that the user has not opened the second door within the time window.

3. The access control method according td claim 1 wherein the first door is an elevator door and the second door is an apartment door or an office door.

4. The access control method according to claim 1 wherein the first door is an exterior door and the second door is an interior door.

5. The access control method according to claim 1 wherein the movement detected at the first door is a movement of the user at the first door.

6. The access control method according to claim 1 wherein the movement detected at the first door is a movement of the first door.

7. The access control method according to claim 1 wherein the identifying the user is performed as portion of placing a destination call for an elevator system.

8. The access control method according to claim 1 wherein the identifying the user is performed by reading information from a data carrier.

9. The access control method according to claim 1 wherein the determining the travel time is performed by reading a pre-defined travel time from a database.

10. The access control method according to claim 1 wherein the determining the travel time is based on a pre-defined walk speed for the user and on a pre-defined distance between the first door and the second door.

11. The access control method according to claim 1 further comprising the steps of:

detecting a movement at the second door;

determining a travel time for the user between the second door and a third door; and granting the user access for the third door after the travel time for the user between the second door and the third door has elapsed since the movement at the second door.

12. The access control method according to claim 1 further comprising the steps of:

determining that the user has not opened the second door within a time window; and canceling an action for granting the user access for a third door.

13. A building access control system comprising:

a first door;

a door sensor for the first door;

an input device for the first door;

a second door, the second door not being an elevator door; and a computer-based control unit, the control unit including a processor and a computer-readable storage medium with instructions that, when executed by the processor, cause the control unit to, identify a user based on a credential presented by the user to the input device, grant the user access for the first door based on the credential, detect a movement at the first door with the door sensor, determine a travel time for the user between the first door and the second door, grant the user access for the second door after the travel time for the user between the first door and the second door has elapsed since the movement detected at the first door, the access for the second door being based without presenting any credentials at the second door; and deny access to the second door after the travel time for the user between the first door and the second door has elapsed and a time limit has elapsed.

14. The building access control system according to claim 13 wherein the first door is an optical turnstile.

15. A computer-readable storage media having encoded thereon instructions that, when executed by a processor, cause the processor to perform a method, the method comprising the steps of:

identifying a user based on a credential presented by the user;

granting the user access for a first door based on the credential;

detecting a movement at the first door;

determining a travel time for the user between the first door and a second door, the second door not being an elevator door;

granting the user access for the second door after the travel time for the user between the first door and the second door has elapsed since the movement detected at the first door, the access for the second door being granted without presenting any credentials at the second door; and denying access to the second door after the travel time for the user between the first door and the second door has elapsed and a time limit has elapsed.

16. The access control method according to claim 1, wherein granting the user access for the second door includes unlocking a lock for the second door.

17. The access control method according to claim 1, wherein ranting the user access for the second door includes opening the second door.

18. The access control method according to claim 1, wherein the credential presented by the user includes using one of a keypad and biometric reader.

19. The access control method according to claim 1, wherein detecting the movement at the first door comprises detecting the user passing through the first door.

20. The access control method according to claim 1, wherein granting the user access for the second door includes granting the user access to a plurality of doors.

* * * * *